US009021718B2

(12) United States Patent
Myerscough

(10) Patent No.: US 9,021,718 B2
(45) Date of Patent: May 5, 2015

(54) BOOT ASSEMBLY

(71) Applicant: Aqua-Lung America, Inc. a Delaware Corporation, Vista, CA (US)

(72) Inventor: Richard Kerr Myerscough, Victoria (CA)

(73) Assignee: Aqua-Lung America, Inc., Vista, CA (US)

( * ) Notice: Subject to any disclaimer, the term of this patent is extended or adjusted under 35 U.S.C. 154(b) by 204 days.

(21) Appl. No.: 13/690,108

(22) Filed: Nov. 30, 2012

(65) Prior Publication Data

US 2013/0086817 A1 Apr. 11, 2013

Related U.S. Application Data

(63) Continuation-in-part of application No. 12/581,882, filed on Oct. 20, 2009, now abandoned.

(51) Int. Cl.

| | |
|---|---|
| ***A43B 5/08*** | (2006.01) |
| ***A43B 3/00*** | (2006.01) |
| ***A43B 1/00*** | (2006.01) |
| ***A43B 3/06*** | (2006.01) |
| ***A43B 7/12*** | (2006.01) |
| ***A43B 19/00*** | (2006.01) |
| ***A43C 11/12*** | (2006.01) |
| ***A43C 11/14*** | (2006.01) |

(52) U.S. Cl.

CPC ..... *A43B 3/00* (2013.01); *A43B 1/0054* (2013.01); *A43B 3/06* (2013.01); *A43B 5/08* (2013.01); *A43B 7/12* (2013.01); *A43B 19/00* (2013.01); *A43C 11/12* (2013.01); *A43C 11/1493* (2013.01)

(58) Field of Classification Search

CPC ..... A43B 5/08
USPC ..... 36/45, 55, 10, 8.1, 3 R, 4
See application file for complete search history.

(56) References Cited

U.S. PATENT DOCUMENTS

| | | | | |
|---|---|---|---|---|
| 5,499,459 | A * | 3/1996 | Tomaro | 36/10 |
| 5,964,047 | A * | 10/1999 | Covatch | 36/55 |
| 6,637,129 | B2 * | 10/2003 | Chen | 36/3 A |
| 6,935,053 | B2 * | 8/2005 | Wiener | 36/14 |
| 2007/0062067 | A1 * | 3/2007 | Covatch | 36/55 |

* cited by examiner

*Primary Examiner* — Ted Kavanaugh
(74) *Attorney, Agent, or Firm* — Davis & Bujold, P.L.L.C.; Michael J. Bujold

(57) ABSTRACT

A boot assembly for use with a dry suit includes an external puncture resistant boot and a dual-layered insert. The dual-layered insert comprises a thermal sock worn over the foot of a diver and a water-proof, non-stretch over-sized outer sock worn over the thermal sock. The outer sock is over-sized so that it accommodates a wide spectrum of diver foot sizes but fits comfortably within the volume of the external boot.

15 Claims, 8 Drawing Sheets

BOOT ASSEMBLY

CROSS-REFERENCE TO RELATED APPLICATIONS

This application is a Continuation-in-Part of application Ser. No. 12/581,882 filed in the USPTO on Oct. 20, 2009 and now expressly abandoned. The latter application claims the benefit of U.S. Provisional Patent Application No. 61/106,574 filed in the USPTO on Oct. 18, 2009.

FEDERAL FUNDING

N/A

FIELD OF THE INVENTION

This invention relates to the field of boots, shoes and leggings and more particularly to a boot assembly used in diving.

BACKGROUND OF THE INVENTION

Diving boots are often fixed to diving pants in a permanent combination. The diving boot will often experience greater wear than the pant because it is the base upon which diver stands. Furthermore, the diver will be placing fins on and off the boot which will cause additional wear. In situations where the boots are permanently fixed to the diving pant leggings, the boots cannot be replaced without cutting them off of the pant leggings and fixing a new pair of boots to the pant leggings. This is a costly and time-consuming process. Additional problems arise in trying to find a set of new boots of the proper size for the diver. Therefore, there is a continuing need for a diving boot assembly that can be used as replacements for worn boots and come in a size that is adaptable to most divers.

SUMMARY OF THE INVENTION

To overcome the deficiencies in the prior art and to provide a boot assembly for use with a dry suit comprising an outer pant and an inner pant my invention comprises a boot assembly comprising an external boot assembly and a dual-layered insert. The external boot comprises a reinforced upper portion and a back portion having a reinforced outside surface and an inside surface. The external boot has a durable outer sole, an inner sole, a reinforced outer heel portion and an inner heel. The external boot is connected to an outer pant leg by a top connecting cuff.

The dual-layered insert comprises an inner thermal fabric sock for over-foot wear and a water-proof outer sock comprising a non-stretch fabric for nesting the inner thermal fabric sock in a water-tight manner. The external boot is puncture resistant and has an interior volume. The water-proof outer sock has an expanded volume that is larger than the interior volume of the external boot so that the water-proof outer sock will accommodate a wide spectrum of diver foot sizes. The outer sock will then readily compress around the inner thermal sock to a volume that will easily fit within the volume of the external boot.

The water-proof outer non-stretch fabric sock includes a cuff for connection to the dry suit inner pant leg bottom cuff creating a water-tight seal between the over-sized non-stretch fabric waterproof outer sock and the dry suit inner pant leg bottom cuff so that the inner thermal fabric sock remains dry when the assembly is submerged in water.

In one embodiment of the invention the cuff of the over-sized non-stretch fabric outer sock is permanently sewn to the inner pant leg cuff of the diving suit and then temporarily taped with water proof tape to provide a water tight seal between the inner leg pant cuff and the over-sized non-stretch fabric outer sock.

In another embodiment of the invention a temporary connection can be used such as a quick disconnect water-proof ring-seal.

In yet another embodiment of the invention, the outer non-stretch fabric water-proof sock nests within the external boot and creates an intermittent void between them. This void is water filled when the boot assembly is submerged.

Further objects and advantages of the invention will become apparent from a consideration of the ensuring description and drawings.

DETAILED DESCRIPTION

Figure 1:
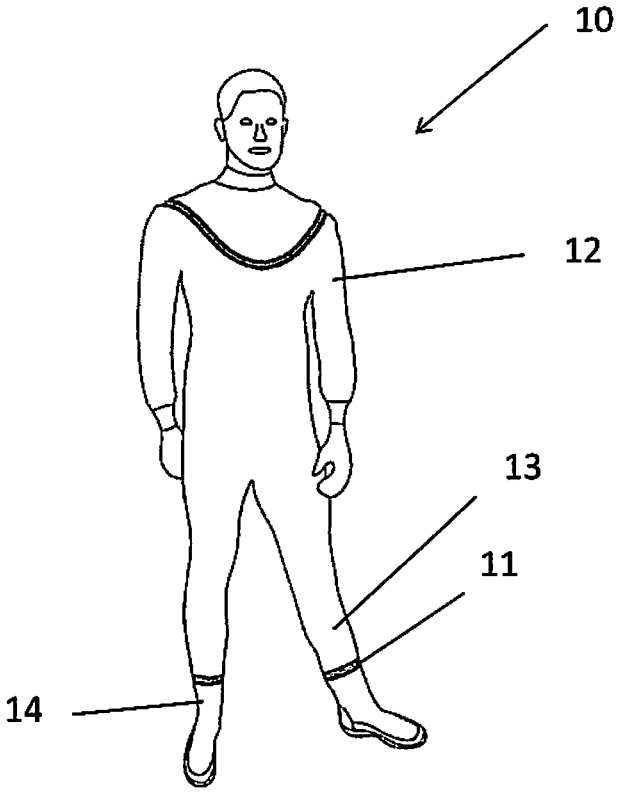
FIG. 1 is a diagram of a diver wearing a diving suit having diving boots.
Figure 2:
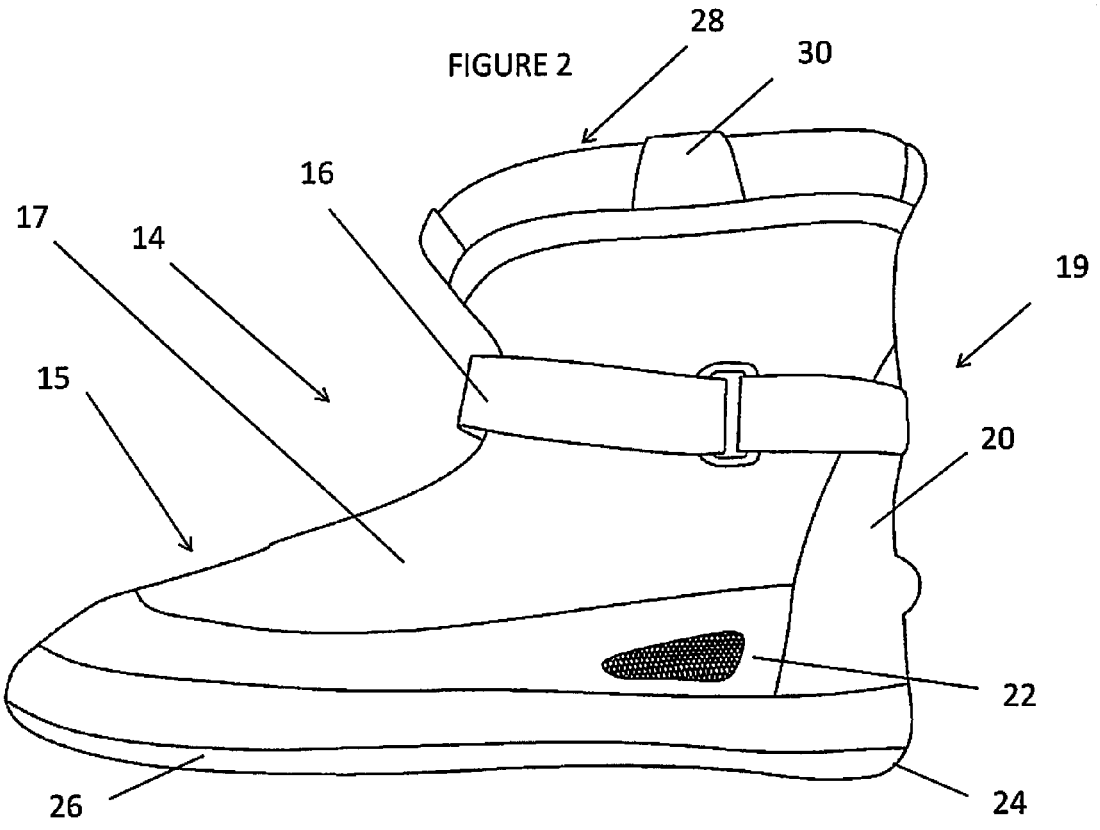
FIG. 2 is a side external view of one embodiment of the invention.

Referring to FIGS. 1 and 2 and one embodiment of the invention is illustrated comprising a boot assembly 14 for use with a dry suit 12 worn by a diver 10. A dry suit 12 comprises a waterproof outer portion comprising a non-stretch fabric and a thermal inside portion. The thermal inside portion keeps the diver 10 warm and the outside portion provides for a dry physical barrier between the water and the thermal inside portion. The dry suit is typically a single piece suit having the torso and legs joined as a single unit. The dry suit pants will have the same waterproof outside pant leg.

Referring to FIG. 2, in this illustrated embodiment of the invention the boot assembly 14 comprises an external boot 15 comprising a reinforced upper portion 17 and a back portion 19 having a reinforced outside surface 20. There is tensioning strap 16 for tightening the upper portion of the boot around the lower leg and ankle of the diver. The external boot further comprises a durable outer sole 26 and an inner sole, a reinforced outer heel portion 24 and an inner heel. There is also and a top connecting cuff 28 for connecting by first connection means 30 to the dry suit 12 outer pant leg 13 bottom cuff 11. Above the outer sole 26 here is positioned a drainage port 22 for draining water from inside the boot.

Figure 3:
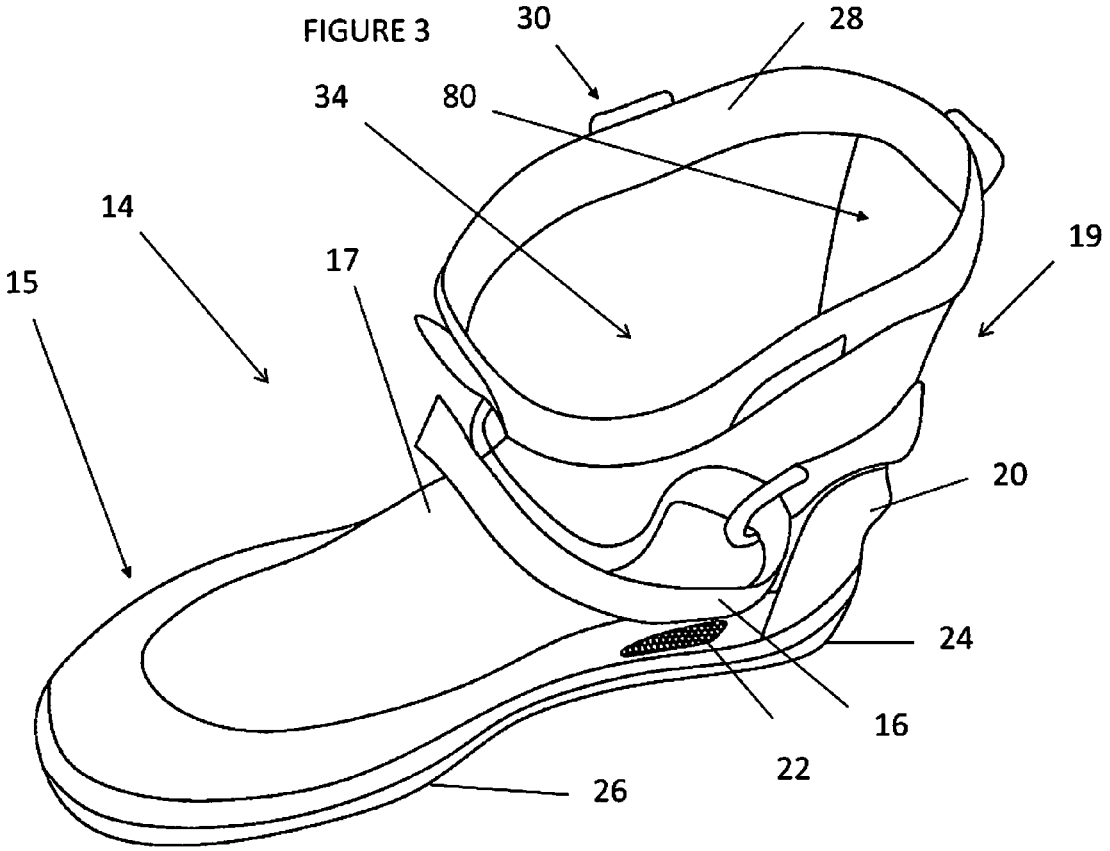
FIG. 3 is a top perspective view of one embodiment of the invention showing the inside of the boot.

Referring to FIG. 3, there is shown a top perspective view of the boot assembly 14 comprising a puncture resistant external boot 15 comprising a reinforced upper portion 17 and a back portion 19 having a reinforced outside surface 20. There is tensioning strap 16 for tightening the upper portion of the boot around the lower leg and ankle of the diver. The external boot further comprises a durable outer sole 26 and an inner sole, a reinforced outer heel portion 24 and an inner heel. There is also and a top connecting cuff 28 for connecting by first connection means 30 to the dry suit 12 outer pant leg 13 bottom cuff 11. Above the outer sole 26 there is positioned a drainage port 22 for draining water from inside the boot. This top perspective view of the boot assembly also illustrates the inside surface 34 of the boot.

Figure 4:
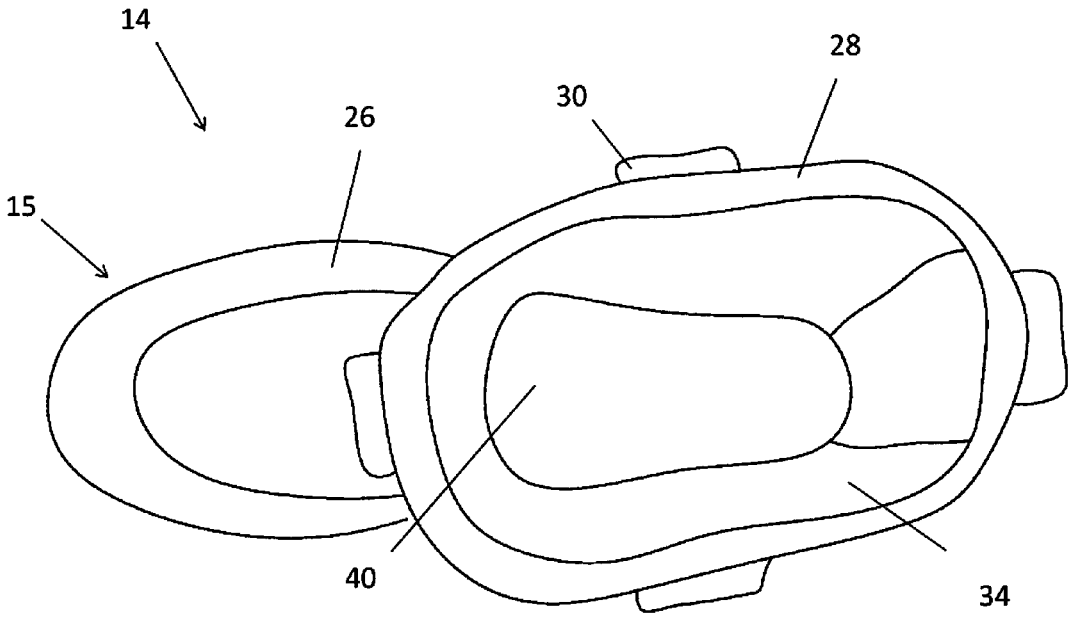
FIG. 4 is a top view of one embodiment of the invention.

Referring to FIG. 4 there is shown a top view of the boot assembly 14 comprising an external boot 15. The external boot further comprises a durable outer sole 26 and an inner sole. There is also a top connecting cuff 28 for connecting by first connection means 30 to the dry suit 12 outer pant leg 13 bottom cuff 11. This top view of the boot assembly also illustrates the inside surface 34 of the boot and the inner sole 40 of the boot.

Figure 5:
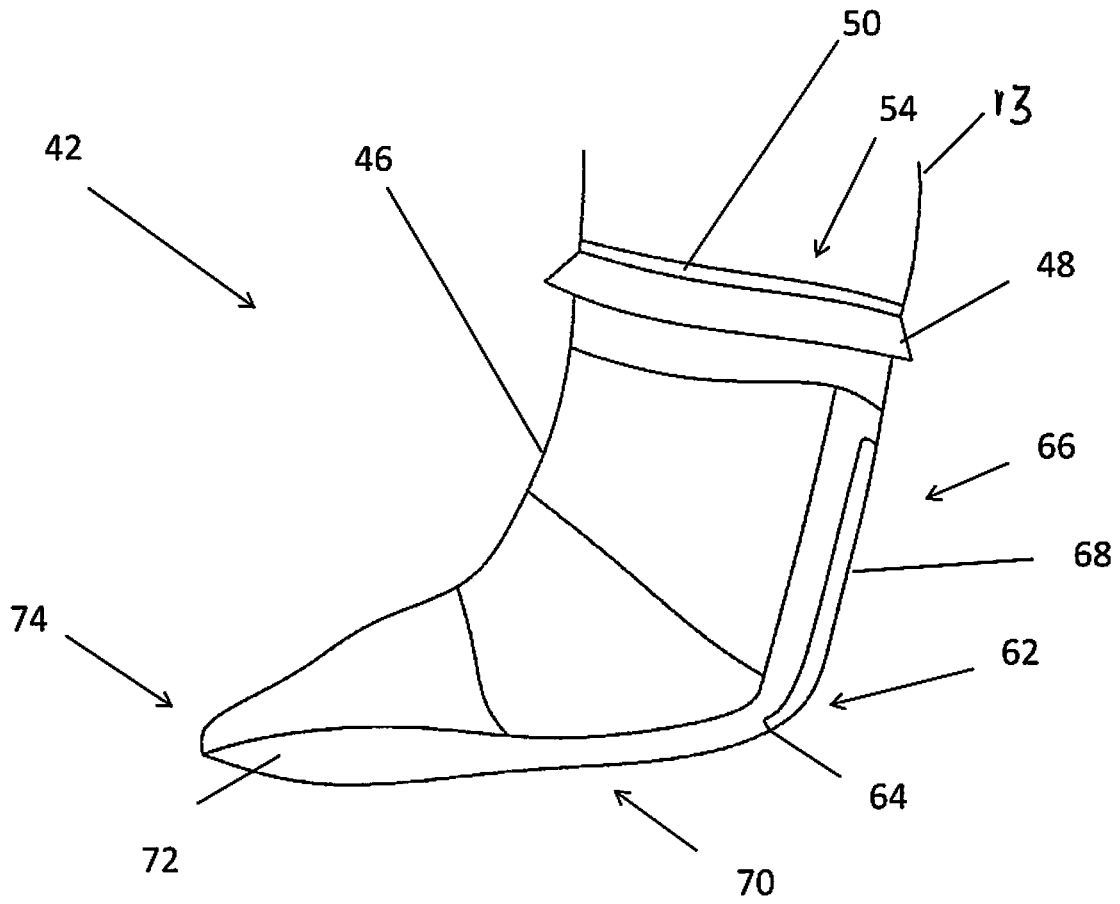
FIG. 5 is a side view of one embodiment of the non-stretch fabric water-proof outer sock.

Referring now to FIG. 5, there is illustrated one embodiment of the dual-layered insert 42 comprising an inner thermal sock 44 (not illustrated in this diagram) that is worn over the foot of the diver and an oversized water-proof outer sock 46 comprising a non-stretch fabric for nesting the thermal inner fabric sock 44 in a water-proof manner. The outer sock has an expanded volume that is larger than the internal volume of the external boot so that the external sock fits a wide spectrum of diver foot sizes. The outer sock can be compressed to fit within the boot comfortably. The water-proof oversized outer sock 46 includes a cuff 48 connected by second connection means 50 to the dry suit outer pant leg 52 bottom cuff 54. Second connection means 50 affords a water-tight seal between the non-stretch fabric water-proof outer sock 46 and the dry suit outer pant leg 52 bottom cuff 54 so that the inner thermal fabric sock on the foot of the diver remains dry when the assembly is submerged in water.

Referring to FIGS. 1 to 5 inclusive, in one embodiment of the invention the first connection means between the external boot 30 and the bottom cuff 54 of the outer pant leg comprises a permanent sewn connection. In another embodiment of the invention the first connection means comprises a temporary connection means comprising a quick disconnect ring-seal. Other suitable connection means can be used as long as they are adapted for underwater applications.

In one embodiment of the invention second connection means 50 comprises a permanent sewn water-proof connection. In another embodiment of the invention second connection means comprises a temporary water-proof connection comprising a quick disconnect water-proof ring-seal. Other connections means can be used as long as they are suitable for underwater use.

Figure 6:
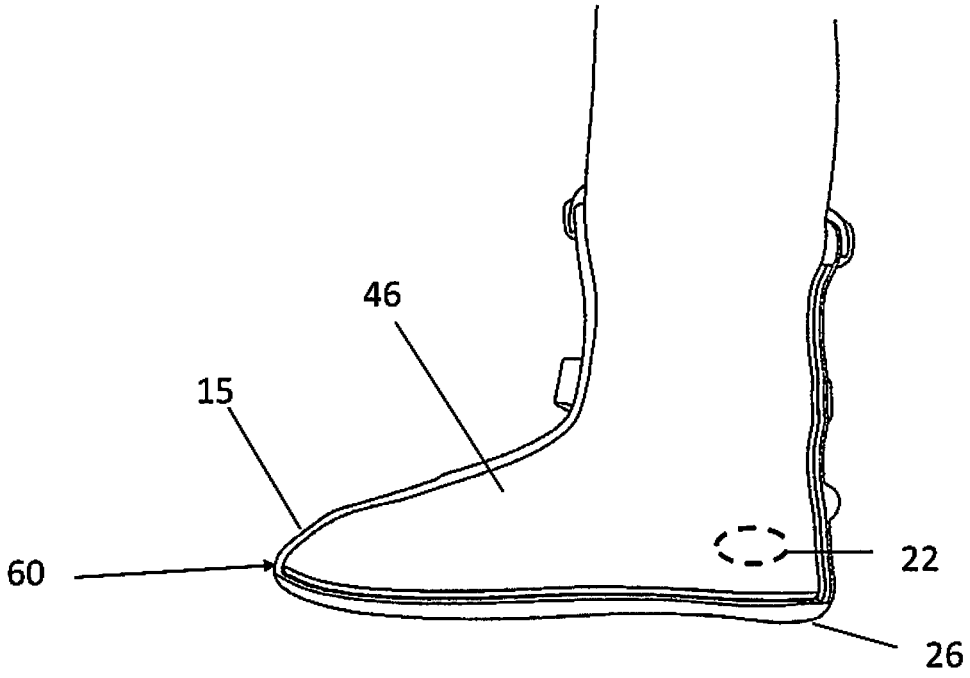
FIG. 6 is a cross-sectional side view of one embodiment of the invention.

Referring now to FIG. 6, there is shown in this embodiment the outer over-sized non-stretch fabric sock 46 nested within the external boot 15. The oversized water-proof non-stretch outer sock conforms substantially to the internal volume and shape of the external boot. The over-sized water-proof non-stretch outer sock fits within the external boot even though it is larger than the external boot. When nested within the external boot it creates an intermittent void 60 between them. The void is intermittent because it will shift as the diver moves his foot inside the external boot. The void will be filled with water when the assembly is submerged. To quickly drain the assembly when it is lifted out of the water, the external boot 15 further comprises at least one drainage port 22 proximate to the durable sole portion 26.

Referring back to FIG. 5, the outer water-proof, over-sized and non-stretch sock 46 comprises a cuff 48, a heel 62 having an outside surface 64, a back panel 66 having an outside surface 68, a sole 70 having an outside surface 72 and a toe 74.

In one embodiment of the invention the water-proof, over-sized and non-stretch outer sock 46 and the external boot 15 are temporarily fixed together by fixing means. In one embodiment of the invention the temporary fixing means comprises a hook and loop fastening system. For example, in FIG. 5, panel 66 outside surface 68 could comprise hooks adapted to mate with loops on the inside surface of the boot. A similar placement of hooks and loops could be placed on the outside surface 72 of the sole of the outer sock and the inside surface of the sole of the boot.

In FIG. 5, and in one embodiment of the invention the external boot 15 inner sole 40 is covered in hooks and the outer over-sized, water-proof and non-stretch sock 46 sole 70 outside surface 72 is covered in loops from heel 74 to the toe 74. The back portion inside surface 80 (FIG. 3) of the external boot 15 could includes a strip of hooks running from the cuff 28 to the heel 24. The back panel 66 outside surface 68 of the outer sock 46 could includes a strip of loops running from the cuff 48 to the heel 62. Hence, when the outer sock 46 is inserted into the external boot the hooks on the boot and the loops on the elastomeric sock mesh to hold the elastomeric sock to the boot. This prevents the sock from lifting as the diver walks and permits the diver to remove her foot from the sock without pulling the sock out of the boot.

Figure 7:
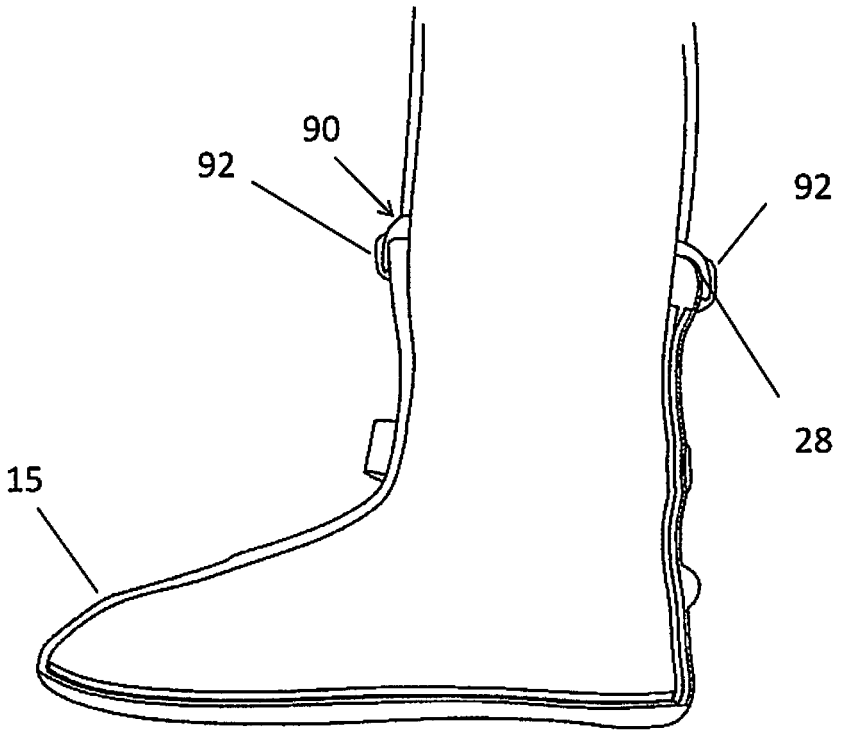
FIG. 7 is a sectional side view of another embodiment of the invention.

Referring to FIG. 7, and in one embodiment of the invention the external boot 15 top connecting cuff 28 first connection means 30 comprises a circumferential outer ring of hooks 90 and a plurality of tabs 92 spaced radially around the connecting cuff. Each of the tabs 92 has an inside surface comprising fastening hooks and a clean outside surface. The dry suit outer leg 13 bottom cuff 11 comprises a circumferential ring of loops disposed on the dry suit bottom cuff inside and outside surfaces. The circumferential ring of loops inside surface meshes with the outer ring of hooks on the cuff of the external boot. The circumferential ring of loops outside surface meshes with the inside surfaces of the plurality of tabs 92 thereby creating a temporary connection between the external boot and the outer leg of the dry suit.

Figure 8:
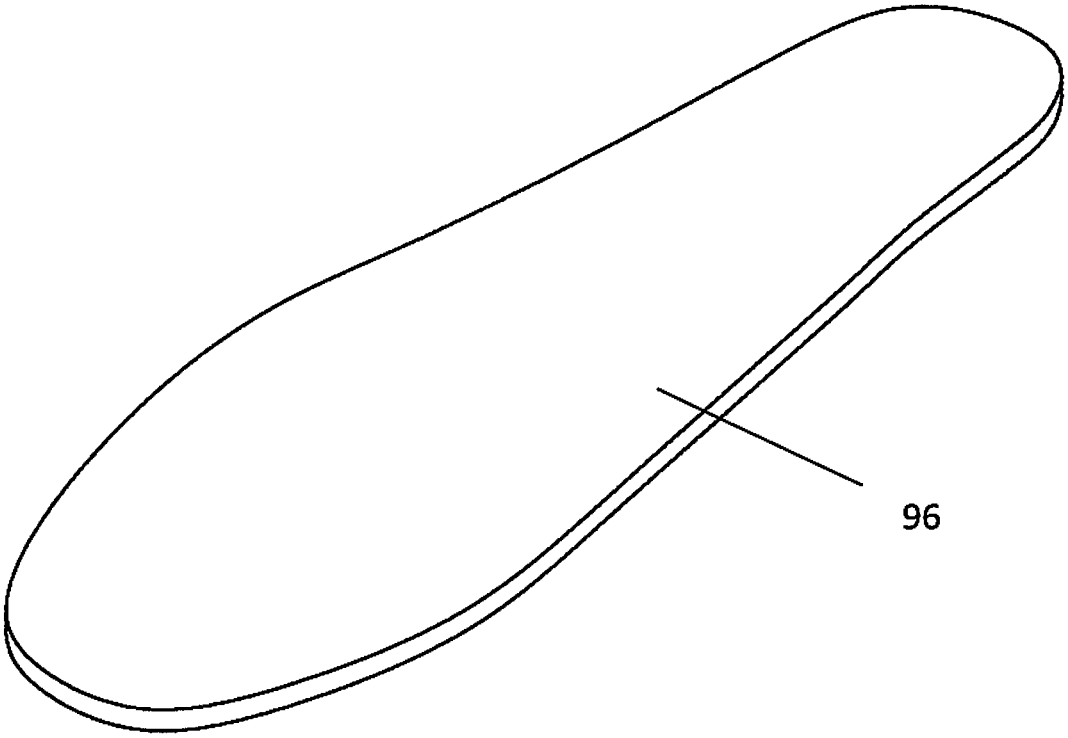
FIG. 8 is a view of one embodiment of a sole.

Referring to FIG. 8, and in one embodiment of the invention the outer water-proof, over-sized and non-stretch sock 46 includes a stiffening insole 96 inserted into the sock. The stretched sole of the outer sock 46 will engage the adjacent inside surfaces of the external boot 15 and provide resistance to lifting of the elastomeric sock within the external boot. The diver will be able to remove her foot from the assembly without pulling the outer sock 46 from the external boot.

In one embodiment of the invention the external boot further includes a tightening strap 16 on the outer surface thereof for constricting the upper portion.

In another embodiment of the invention there is contemplated a boot assembly for wearing as an all weather boot, winter boot or fishing boot. In this embodiment there is a boot assembly comprising an external boot comprising a reinforced upper portion and a back portion having a reinforced outside surface and an inside surface. The boot has a durable outer sole and an inner sole, a reinforced outer heel portion and an inner heel. The boot further has a top connecting cuff for connection by connection means to a dual-layered insert. The dual layer insert comprises an inner thermal fabric sock for over-foot wear and a waterproof outer over-sized, water-proof and non-stretch sock for nesting the inner fabric sock in a water-tight manner. The waterproof outer sock includes a cuff connected by connection means to the external boot thereby affording a water-tight seal between the external boot and the water-proof outer sock.

Although the description above contains much specificity, these should not be construed as limiting the scope of the invention but as merely providing illustrations of some of the present preferred embodiments of the invention. The scope of the invention should be determined by the appended claims and their legal equivalents rather than by the examples given.

What is claimed is:

1. A boot assembly for use with a dry suit, said boot assembly comprising:

a) a puncture resistant external boot having an interior volume and an external boot top connecting cuff for connection by a first connection means to a dry suit outer pant leg bottom cuff;

b) a dual-layered insert comprising:

i) a thermal inner sock worn over a foot of a diver; and, ii) a water-proof outer sock worn over said thermal inner sock, the water-proof outer sock comprising a non-stretch fabric, and an outer sock top connecting cuff for connection by a second connection means to said dry suit outer, pant leg bottom cuff for a water-tight seal, wherein:

1) said water-proof outer sock has an expanded volume that is larger than said interior volume to accommodate a wide spectrum of diver foot sizes; and, 2) when said diver inserts the water-proof outer sock having said expanded volume into the external boot the expanded volume will easily compress to a compressed volume to fit comfortably within the interior volume.

2. The boot assembly of claim 1 wherein the external boot comprises:

a) a reinforced upper portion and a back portion having a reinforced outside surface and an inside surface;

b) a durable outer sole and an inner sole having a top surface; and c) a reinforced outer heel portion and an inner heel.

3. The boot assembly of claim 1 wherein said first connection means comprises a water-proof permanent sewn connection.

4. The boot assembly of claim 3 wherein the first connection means comprises a first water-proof quick disconnect ring seal.

5. The boot assembly of claim 4 wherein said second connection means comprises a second water-proof quick disconnect ring seal.

6. The boot assembly of claim 5 wherein when the water-proof outer sock is secure within the external boot an intermittent void is created between them and said intermittent void is water filled when the assembly is submerged.

7. The boot assembly of claim 6 wherein the external boot further comprises at least one drainage hole proximate to said durable outer sole portion for draining the intermittent void when the assembly is removed from water.

8. The boot assembly of claim 7 wherein the water-proof outer sock further comprises a cuff, a heel having an outside surface, a back panel having an outside surface, a gusset, a sole having an outside surface, a toe and an instep.

9. The boot assembly of claim 8 wherein when the water-proof outer sock is inserted into the external boot it is temporarily fixed to an inside surface of the external boot by a fixing means.

10. The boot assembly of claim 9 wherein said fixing means comprises a hooks and loops fastening system wherein said top surface of said inner sole is covered in said hooks and said water-proof outer sock outside surface is covered in said loops from said heel to said toe.

11. The boot assembly of claim 10 wherein said external boot back portion inside surface comprises a strip of hooks running from said top connecting cuff to said inner heel and wherein said back panel outside surface of the water-proof outer sock comprises a strip of loops running from said outer sock top connecting cuff of the said water-proof outer sock heel so that when the water-proof outer sock is inserted into the external boot the hooks on the external boot and the loops on the water-proof outer sock will mesh to temporarily secure the water-proof outer sock within the external boot.

12. The boot assembly of claim 5 wherein said first and said second water-proof quick disconnect ring seals comprise a circumferential outer ring of hooks and a plurality of tabs spaced radially around the connecting cuff and wherein each of said tabs has an inside surface comprising fastening hooks and a clean outside surface.

13. The boot assembly of claim 12 wherein the dry suit outer leg bottom cuff comprises a circumferential ring of loops disposed on the dry suit bottom cuff inside and outside surfaces.

14. The boot assembly of claim 13 wherein said circumferential ring of loops inside surface meshes with said outer ring of hooks and wherein said circumferential ring of loops outside surface meshes with said inside surfaces of the plurality of tabs thereby creating a temporary connection.

15. The boot assembly of claim 14 wherein the water-proof outer sock includes a stiffening insole inserted therein so that the sole of the water-proof outer sock will engage the adjacent inside surface of the external boot inner sole and provide resistance to lifting of the water-proof outer sock within the external boot.

* * * * *